US005573026A

United States Patent [19]

Griffith

[11] Patent Number: 5,573,026

[45] Date of Patent: Nov. 12, 1996

[54] BOAT LIFT CANOPY

[76] Inventor: Gary Griffith, 3000 Shannon Dr., Punta Gorda, Fla. 33982

[21] Appl. No.: 412,692

[22] Filed: Mar. 29, 1995

[51] Int. Cl.[6] ..... E04H 15/18; E04H 15/34

[52] U.S. Cl. ..... 135/122; 135/90; 135/97; 135/156; 135/117; 135/120.4; 135/908; 52/73; 52/74; 114/361

[58] Field of Search ..... 114/361, 263; 52/73, 74, 77; 135/87, 90, 97, 122, 156, 115, 117, 120.4, 908, 121

[56] References Cited

U.S. PATENT DOCUMENTS

| | | | |
|---|---|---|---|
| 2,693,195 | 11/1954 | Frieder et al. | 135/122 X |
| 2,698,629 | 1/1955 | Hall . | |
| 3,083,540 | 4/1963 | Smith . | |
| 3,572,779 | 3/1971 | Dawson . | |
| 4,019,212 | 4/1977 | Downer | 135/156 X |
| 4,426,761 | 1/1984 | Sassak . | |
| 4,601,606 | 7/1986 | Eason | 114/263 X |
| 4,667,692 | 5/1987 | Tury et al. | 135/156 |
| 4,683,901 | 8/1987 | Mitchell | 114/361 X |
| 4,747,363 | 5/1988 | MacMillan et al. | 114/361 |
| 5,101,844 | 4/1992 | Morrone | 135/33.5 |

FOREIGN PATENT DOCUMENTS

| | | | |
|---|---|---|---|
| 0346997 | 7/1960 | Switzerland | 135/122 |

*Primary Examiner*—Wynn Wood
*Attorney, Agent, or Firm*—Frank A. Lukasik

[57] ABSTRACT

The invention is a pre-fabricated boat lift canopy constructed of galvanized steel or aluminum tubing. All joints are crimped to a tight, permanent fit by using a special rolling tool. The canopy frame is mounted on "I" beams of existing boat lifts, docks, or pilings. The canopy frame is then covered with a water tight and sunlight resistant decorative canopy. Wind spoilers, in the form of canvas strips, are fastened to the peak of the canopy, a continuous strip, horizontally across the top, a strip at each end, and a third strip at the center.

3 Claims, 6 Drawing Sheets

BOAT LIFT CANOPY

BACKGROUND OF THE INVENTION

Field of the Invention

The invention relates generally to a boat cover and more particularly to a boat cover mounted on a boat lift.

The sheltering of boats presents many problems not encountered in conventional shelters. Boat houses can be very expensive due to the terrain encountered along a shoreline and the required strength to withstand strong wind gusts in areas vulnerable to gales and hurricanes. Also, it is desirable to have access to the shelter by driving the boat under the shelter or running the boat into the boat lifting mechanism. Because of the large structures required to build boat houses, with required footers and additional strength to carry the weight of the boat house, it is impractical to shelter a boat to be suspended on a boat lift.

In the prior art it is old to provide a boat dock that includes an open framework mounting a roof and which may be provided with side walls, and also to mount vertically elevatable cradle devices on the framework for lifting the boat out of the water at a location out of the water. U.S. Pat. No. 2,698,629 to Hall discloses a portable vehicle shelter with a frame over which is disposed a cover formed of duck, canvas, or other suitable materials. Inverted "U" shaped yokes are provided at front and rear ends of the frame and midway the length of the frame.

U.S. Pat. No. 3,083,540 to Smith discloses a portable boat lift and a movable roof which is adapted to be hydraulically operated and a roof that automatically raises for easy boarding of the boat when the boat is lowered into the water. The lift is provided with a cradle having a pair of lifting arms which may be elevated to raise a boat clear of the water. The roof comprises a frame having outer side tubular rails which are inter-connected by a plurality of curved tubular cross members. The frame is covered with any suitable material, such as canvas. The roof is adapted to be rocked or pivoted about the longitudinal tube as an axle.

U.S. Pat. No. 4,019,212 to Downer discloses a boat cover apparatus that is on a lift assembly supporting a boat above the level of the water, and cover apparatus that includes a cover assembly having a collapsible cover mounted by a cover frame to abut against the upper, outer peripheral edge portion of a boat as the cover assembly is moved between an elevated position and a cable assembly for selectively elevating the entire cover assembly above the boat and alternatively lowering the cover assembly.

U.S. Pat. No. 4,683,901 to Mitchell discloses a cover for floating boat docks which utilizes precut, coated, fiber canvases, vertical and horizontal support elements, multiple rotatable couplings and detachable shoe-like receptacles, together with lacing rode and other miscellaneous hardware, to provide a shelter for a boat secured in a floating dock. Each of the partially pre-assembled vertical support elements is unfolded and re-enforced on the site with a lateral support member and a pair of angular truss members. A top canvas, two side canvasses, and a front and rear canvas are lashed to the front and rear roof members.

Collapsible structures from other applications have made contributions to the art but none meet the needs of boat covers as simply and as economically as does the present invention. The present invention meets its major objective of ease of assembly with a design that simultaneously provides resiliency, ease of assembly and economy not found in the boat lifts of the prior art.

SUMMARY OF THE INVENTION

The instant invention is a pre-fabricated boat lift canopy constructed of galvanized steel or aluminum tubing. All joints are swaged to a tight fit by using a special rolling tool. The canopy frame is then mounted on "I" beams of existing boat lifts, docks, or pilings. The canopy frame is then covered with a water tight and sunlight resistant decorative canopy. Wind spoilers, in the form of canvas strips, are fastened to the peak of the canopy, a continuous strip, horizontally across the top, a strip at each end, and a third strip at the center.

DETAILED DESCRIPTION OF A PREFERRED EMBODIMENT

Figure 5:
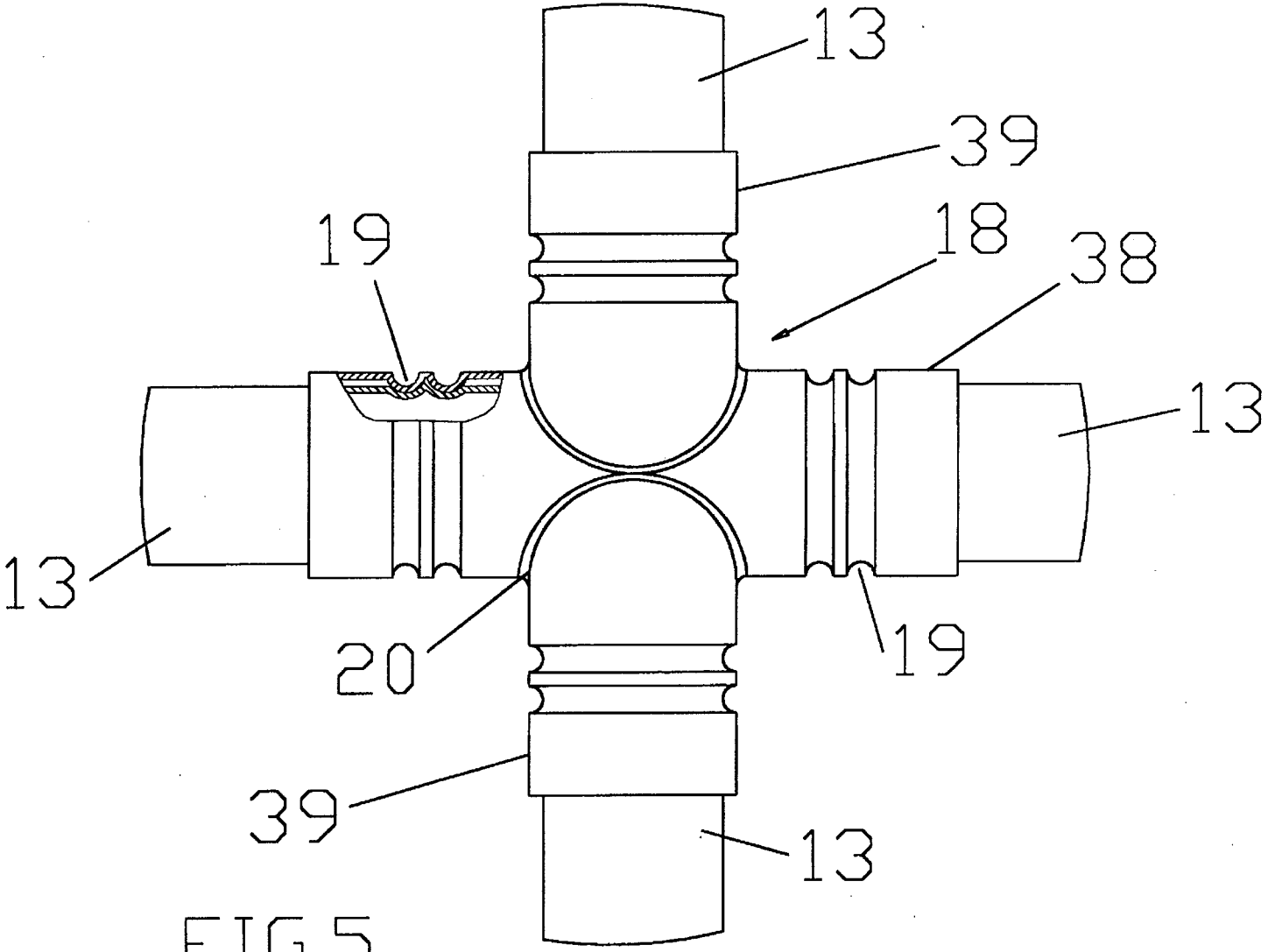
FIG. 5 is a side view, partially in section of a typical frame joint in accordance with the invention.

The present invention is a canopy for sheltering a boat which is supported above the water by a boat lift indicated generally by the numeral 44. The boat canopy, indicated generally by the numeral 10 is easily assembled and quickly erected on a selected boat lift 44. The canopy frame 13 is generally constructed of 1⅝" OD conduit tubing with 0.40" wall thickness. The frame joints 18 are preferably constructed of tubing with 1⅞" OD with 0.60 wall thickness. A typical frame joint 18 is shown in FIG. 5 with sections of canopy frame 13 joined with a process of crimping with a crimping tool 24 in accordance with the invention.

The canopy frame 13, of a preferred embodiment, comprises three horizontal tubes 29, and five horizontal "A" frames 30, each of the connections forming the frame 13 being joined by use of a frame joint 18. Alternative methods of joining sections of tubing, such as, for example, welding, may also be used. The frame joints 18 may be formed at the appropriate angles to form "A" frames 30 depending on the width of the boat 28 and boat lift 44.

Since the horizontal distance between the piles 14 supporting boat lift 44, is generally less than the length of the boat 28, the horizontal length tubes 29, of the frame 13, extend to a length which will provide cover for the entire boat 28. The extended frame 13 ends are supported by angular truss members 32, attached to the base of vertical support legs 31. A third set of vertical support legs 31 are fastened to the center point of horizontal length tubes 29 with frame joints 18 which also fasten the center "A" frame 30.

The canopy frame 13 is attached to "I" beams 27 with clamps 26 affixed to the vertical support legs 31. Clamps 26 may preferably be made of 4" channel with steel plates placed under the flange (top panel) of "I" beam 27 and bolts run through holes drilled in clamps 26 and the steel plates and drawn together to grip the flange of "I" beam 27.

A top cover 11 assembly is placed over the frame 13 and tied to the frame 13 with elastic cords 15 (bungee cords). The cords 15 may consist of numerous lengths cut to the appropriate length and either tied or fastened with plastic hooks mounted on the ends of the cords 15. The top cover 11 assembly may be made from coated fiber canvas or other rugged material suitable for external use.

A second, partial cover, spoiler flap 12 is placed over the top of cover 11. Spoiler flap 12 consists of a top strip 33, running along the entire peak of the canopy 10, and three short strips 34, 35, and 36, one at each end of the top strip 33, and one in the center, all sloping downwardly toward horizontal length tubes 29. The two end strips 34 and 36 are fastened at their outer ends, with cords 15, to the end "A" frames 30. The short strips 34, 35, and 36 of spoiler flap 12 are fastened to horizontal length tubes 29 with the ends 25A of nylon line 25.

Figure 1:
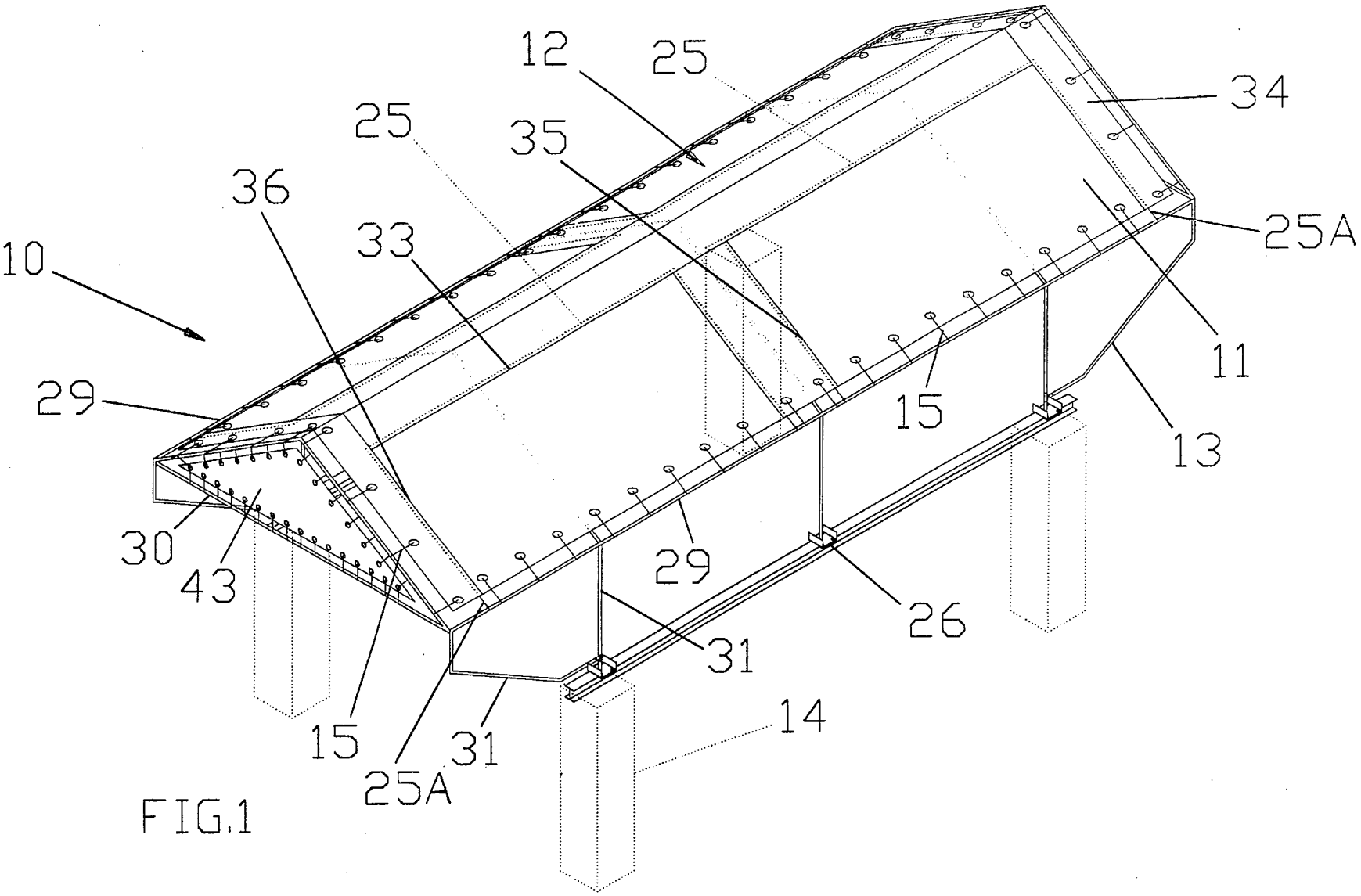
FIG. 1 is a top isometric view of a boat lift canopy in accordance with the invention.
Figures 2, 3:
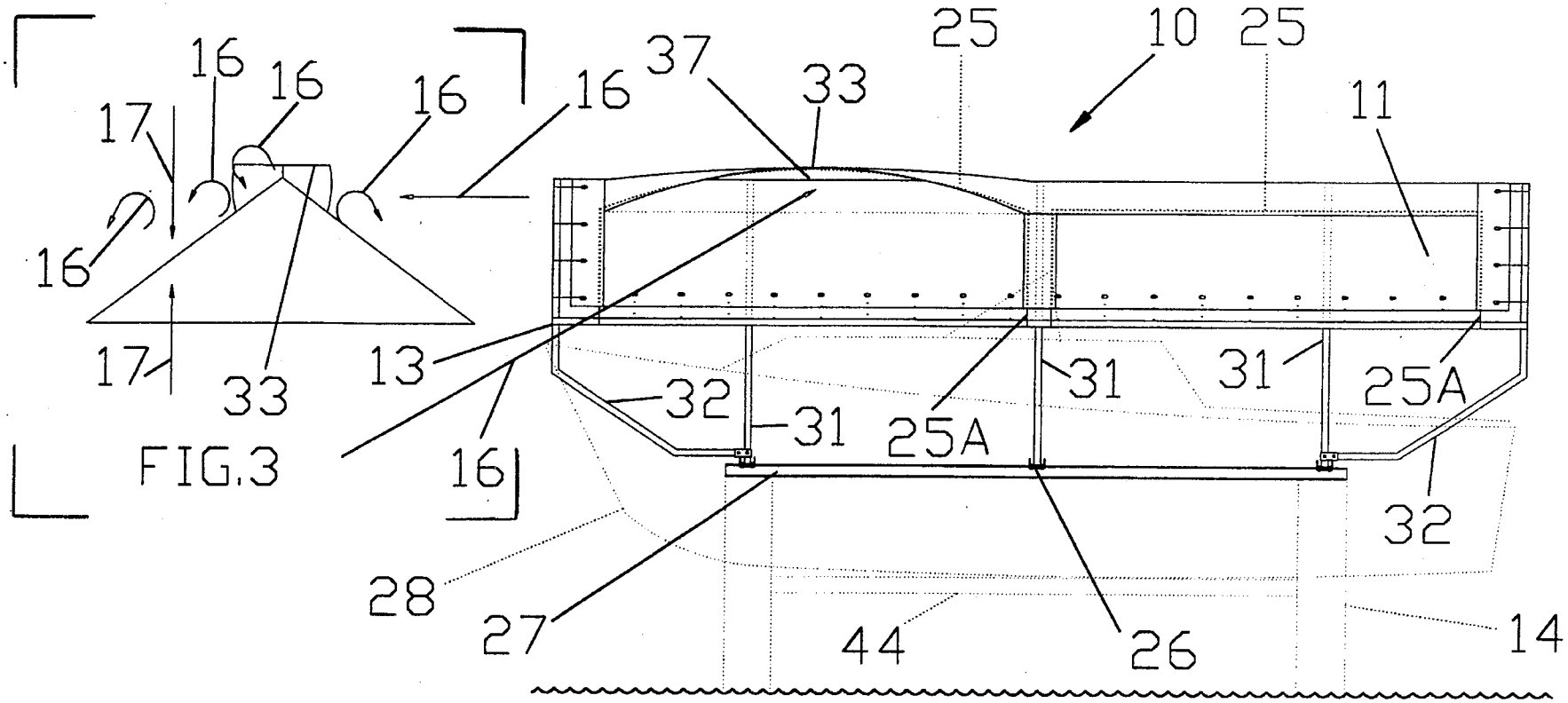
FIG. 2 is a side elevation of a boat lift canopy showing an air flow effect on a spoiler.
FIG. 3 is an end view schematic of an air flow on top and bottom of the canopy.
Figure 4:
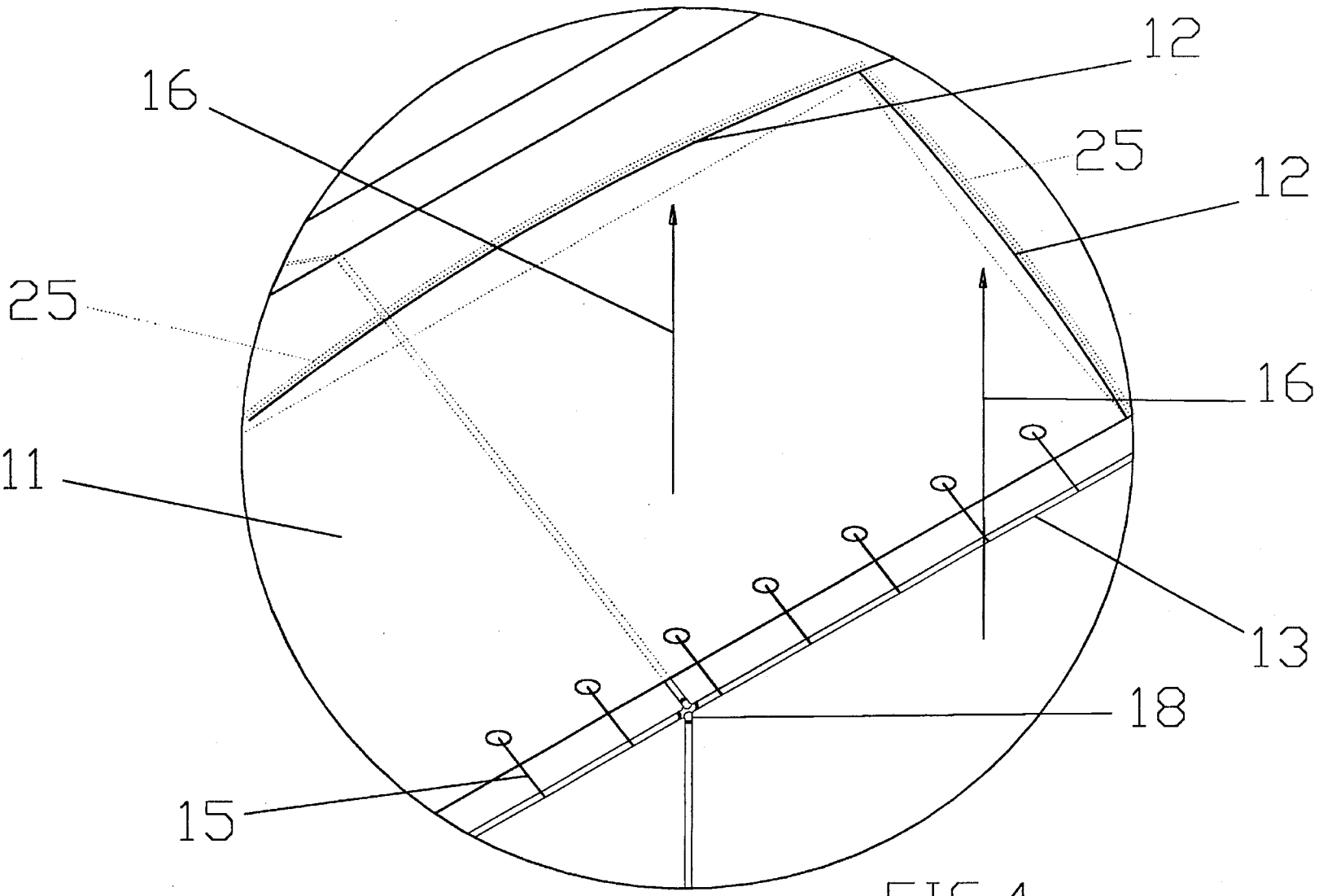
FIG. 4 is an expanded isometric view of a section of the canopy.

A length of nylon line 25 is sewn in the inner edges of strips 33–36 and tied to horizontal length tubes 29 at each end 25A, thus retaining the spoiler flap 12 overlapping the comb of the roof formed by cover 11. FIGS. 2–4 show the action of spoiler flap 12 as it reacts to the force of air flow, wind 16. FIG. 3 is a close-up view of the spoiler 12 showing the wind 16 lifting top strip 33. With the lifting of top strip 33, thus forming a gap 37 between the top strip 33 and cover 11, the wind 16 is deflected and turbulence is created behind the top strip 33 and equal pressure 17 is created on the top and bottom of canopy cover 11. The modification of air pressure and air flow over and under the boat canopy 10 greatly increases the ability of the boat canopy 10 to withstand winds of greater velocity than without the spoiler 12.

FIG. 5 shows a typical frame joint 18 with an assembly of four tubular members of frame 13. Frame joint 18 is made from a single straight section 38 of tube with various required tube connections 39 being welded to the straight section 38 as shown by welds 20.

Figure 6:
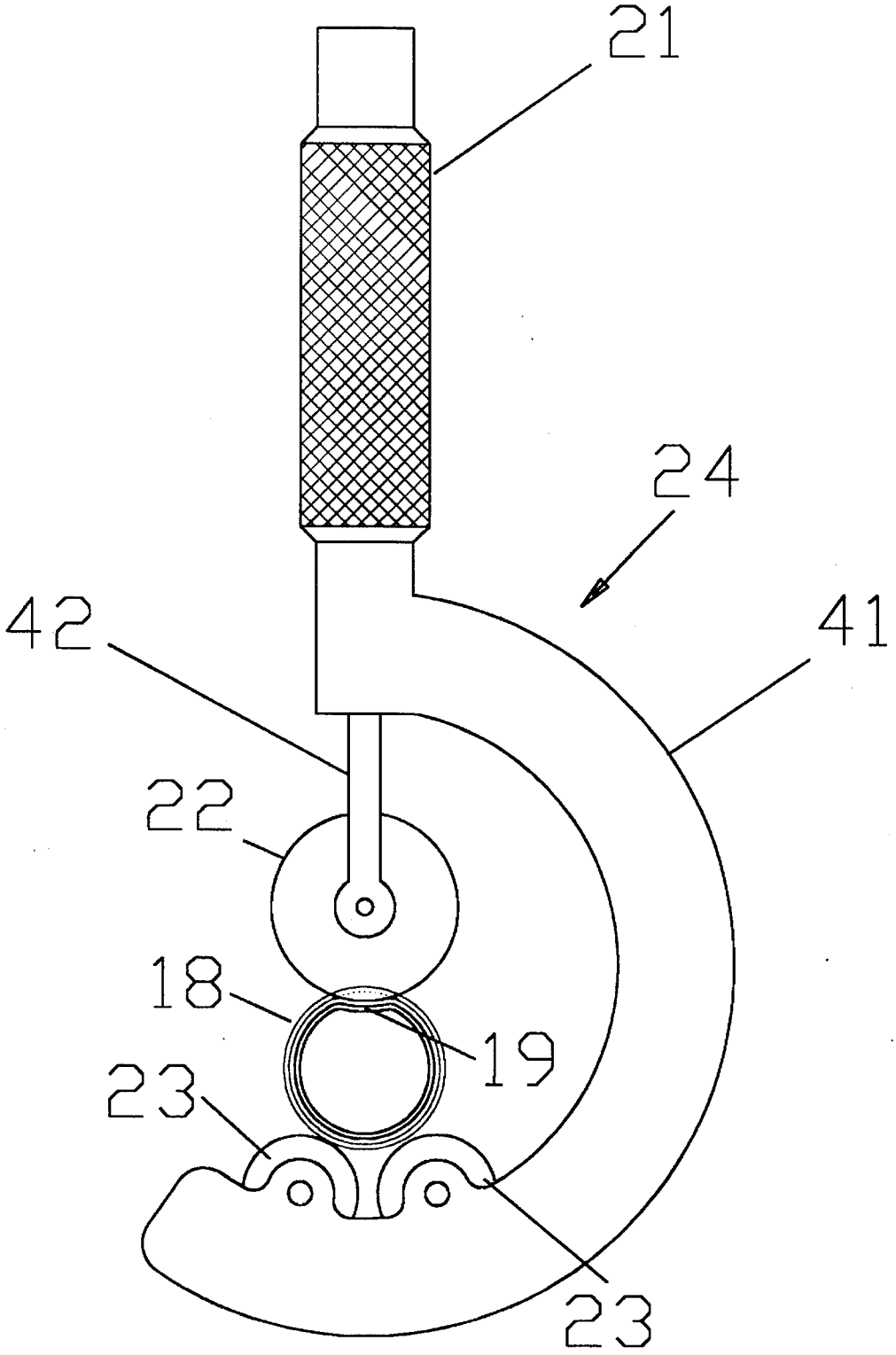
FIG. 6 is a side view of a rolling crimping tool in accordance with the invention.
Figure 7:
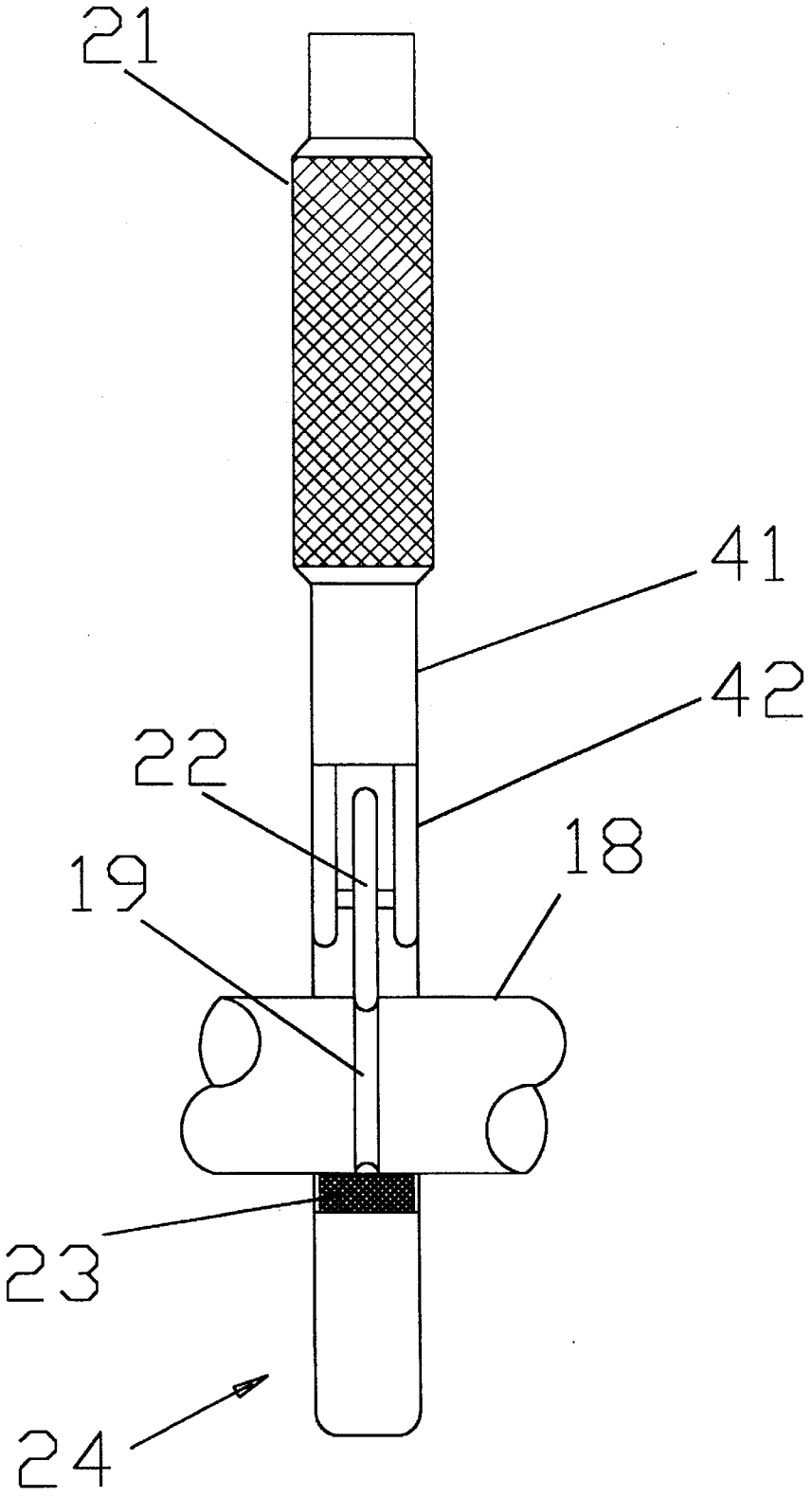
FIG. 7 is a front view of a rolling tool in accordance with the invention.

FIGS. 6 and 7 show the crimping tool 24 for forming the crimp groove 19 for joining sections of tubing to form frame 13. Crimping tool 24 comprises a "C" shaped frame 41 (micrometer shape) having an adjustable hand piece 21 located on the top end of the "C" for varying the depth of crimp groove 19. A crimping wheel 22 is pivotally mounted on forked shaft 42. The opposite end of forked shaft 42, is threaded with external threads (not shown), which are driven by internal threads (not shown) in hand piece 21. At the bottom end of the "C" of tool 24, two bottom rollers 23 are pivotally mounted directly opposing crimping wheel 22. In practice, a section of frame 13 tubing is inserted into a selected section of joint 18 to be assembled together. The crimping tool 24 is wrapped over the intended crimping, and the hand piece 21 is rotated until sufficient pressure is applied to deform the junction. The crimping tool 24 is then rotated to form a complete circular indentation. The hand piece 21 is further rotated as tool 24 is rotated depth. The crimping process is repeated for each of the required joints.

End panels 43 may be installed at each end of frame 13 to provide additional cover for the bow and stern of the boat 28. The tubing used to fabricate the frame 13 may be steel or aluminum.

While the invention has been explained with respect to a preferred embodiment thereof, it is contemplated that various changes may be made in the invention without departing from the spirit and scope thereof.

What is claimed is:

1. A pre-fabricated canopy for sheltering a boat supported above the water by a boat lift comprising:

a boat lift having a pair of parallel, steel, "I" beams mounted on, and supported by, piles, a canopy frame constructed of multiple sections of tubing joined together to form a plurality of horizontal tubes running the length of the canopy, a plurality of "A" frames spanning the width of said frame and joined to said horizontal tubes, said canopy frame having a length greater than the length of said "I" beams, and said frame being supported at opposite ends by angular truss members, a plurality of vertical support legs, each having an upper end and a lower end, each of said upper ends joined to said canopy frame, and each of said lower ends affixed to said "I" beams for supporting said canopy frame, said truss members being fastened to said support legs near said lower ends, a top cover and end covers placed over said canopy frame and attached to said canopy frame with elastic cords, and a partial cover placed over said top cover and attached to said canopy frame with elastic cords and nylon line, whereby said partial cover deflects the wind and reduces wind pressure on said canopy.

2. A pre-fabricated canopy of claim 1 wherein said multiple sections of tubing are inserted in and joined together with frame joints having mating, multiple tubing sections welded together in appropriate shapes, said sections of tubing and frame joints being crimped together with a crimping tool to form a permanent connection.

3. A pre-fabricated canopy for sheltering a boat supported above the water by a boat lift comprising:

a boat lift having a pair of parallel, steel "I" beams mounted on, and supported by, piles, a canopy frame constructed of multiple sections of tubing joined together to form a plurality of horizontal tubes running the length of the canopy, a plurality of "A" frames spanning the width of said frame and joined to said horizontal tubes, said canopy frame having a length greater than the length of said "I" beams, said frame being supported at opposite ends by angular trusses, and said sections of tubing being inserted in and joined together with frame joints having multiple tubing sections welded together in appropriate shapes, said sections of tubing and frame joints being crimped together to form permanent connections, a plurality of vertical support legs, each having an upper end and a lower end, each of said upper ends joined to said canopy frame, and each of said lower ends affixed to said "I" beams for supporting said canopy frame, a top cover and end covers placed over said canopy frame and attached to said canopy frame with elastic cords, and a partial cover placed over said top cover and attached to said canopy frame with elastic cords and nylon line, said partial cover consisting of a top strip having a first end, a center, a second end, said top strip, having an inner edge, and an outer edge, said partial cover running along the entire length of said top cover, and three short strips fastened to said top strip, one short strip at each of said first and second ends and said center of said top strip, and one short strip at the center of said top strip, said nylon being sewn along said inner edges of said three short strips and fastened to said horizontal tubes and said outer edges of said short strips being fastened to said "A" frames and said horizontal tubes, whereby said partial cover deflects the wind and reduces wind pressure on said canopy.

* * * * *